US009541294B2

(12) United States Patent
Angulo

(10) Patent No.: US 9,541,294 B2
(45) Date of Patent: Jan. 10, 2017

(54) INNER SWIRLING FLAME GAS BURNER

(71) Applicant: Whirlpool Corporation, Benton Harbor, MI (US)

(72) Inventor: Jorge Richard Angulo, Celaya (MX)

(73) Assignee: Whirlpool Corporation, Benton Harbor, MI (US)

( * ) Notice: Subject to any disclaimer, the term of this patent is extended or adjusted under 35 U.S.C. 154(b) by 669 days.

(21) Appl. No.: 13/959,775

(22) Filed: Aug. 6, 2013

(65) Prior Publication Data

US 2015/0040887 A1 Feb. 12, 2015

(51) Int. Cl.

| | |
|---|---|
| ***F24C 3/08*** | (2006.01) |
| ***F23D 14/58*** | (2006.01) |
| ***F23D 14/64*** | (2006.01) |
| ***F23D 14/06*** | (2006.01) |
| ***F24C 15/10*** | (2006.01) |
| *F24C 3/02* | (2006.01) |

(52) U.S. Cl.

CPC ..... *F24C 3/08* (2013.01); *F23D 14/06* (2013.01); *F23D 14/583* (2013.01); *F23D 14/64* (2013.01); *F24C 3/085* (2013.01); *F24C 15/108* (2013.01); *F23D 2203/1017* (2013.01)

(58) Field of Classification Search

CPC ..... F24C 3/08; F24C 3/085; F24C 3/027; F24C 15/108; F23D 14/583; F23D 14/64; F23D 14/06; F23D 2203/1017; Y02B 40/166

USPC ..... 126/39 E, 39 R

IPC ..... F24C 3/08, 3/02, 15/10; F23D 14/58, 14/64, 14/06

See application file for complete search history.

(56) References Cited

U.S. PATENT DOCUMENTS

| | | | | |
|---|---|---|---|---|
| 794,545 A | | 7/1905 | Phillips | |
| 1,376,241 A | * | 4/1921 | Wright | F24C 3/08 126/214 D |

(Continued)

FOREIGN PATENT DOCUMENTS

| | | |
|---|---|---|
| EP | 0534304 A2 | 3/1993 |
| FR | 400388 | 7/1909 |

(Continued)

OTHER PUBLICATIONS

"JP_2006098001_A_M_Machine Translation.pdf", Machine Translation, J-Plat Pat, Mar. 3, 2016.*

(Continued)

*Primary Examiner* — Gregory Huson
*Assistant Examiner* — Daniel E Namay

(57) ABSTRACT

A gas burner having a combustion chamber with a bottom and a circumferential wall. A plurality of fuel exit ports are disposed in the circumferential wall, and are directed generally inwardly toward the combustion chamber and upwardly from the bottom of the combustion chamber. The fuel exit ports are preferably directed inwardly at an angle that is slightly rotated from a central axis of the burner to create a swirling flame. A plurality of secondary air inlets extend through the bottom of the combustion chamber. An injector orifice is aligned with the central axis of the burner. The injector orifice is secured to the cooktop using a bracket, which has an orifice-securing surface, with two sidewalls extending therefrom and terminating in fastening flanges. The fastening flanges have asymmetrically arranged slots therein to receive tabs extending from the burner to ensure proper alignment of the burner and the injector orifice.

16 Claims, 15 Drawing Sheets

(56) References Cited

U.S. PATENT DOCUMENTS 2,410,547 A * 11/1946 McCollum ..... B60H 1/2212 126/110 R
2,805,710 A 9/1957 Brumbaugh
4,583,941 A 4/1986 Elperin et al.
5,437,262 A 8/1995 George, II et al.
5,649,822 A * 7/1997 Gertler ..... F23D 14/06 126/39 E
6,619,280 B1 9/2003 Zhou et al.
6,832,607 B2 12/2004 Zhou et al.
7,083,123 B2 8/2006 Molla
7,094,050 B2 8/2006 Inomata
7,101,174 B2 9/2006 Tomiura et al.
7,819,657 B2 * 10/2010 Molla ..... F23D 14/065 126/39 E
7,901,205 B2 * 3/2011 Trochou ..... F23D 14/06 126/39 E
7,942,143 B2 5/2011 Lee et al.
8,220,450 B2 7/2012 Luo et al.
8,616,193 B2 * 12/2013 Padgett ..... F23D 14/06 126/39 E
8,899,972 B2 * 12/2014 Fowler ..... F23D 14/06 126/39 E
9,416,963 B2 * 8/2016 Armanni ..... F23D 14/06
2005/0112520 A1 * 5/2005 Todoli ..... F23D 14/06 431/349
2005/0277079 A1 12/2005 Wu
2005/0277080 A1 12/2005 Wu
2006/0147865 A1 7/2006 Czajka
2009/0087804 A1 * 4/2009 Pryor ..... F23D 14/06 431/350
2009/0320823 A1 12/2009 Padgett
2010/0126496 A1 * 5/2010 Luo ..... F23D 14/06 126/39 E
2010/0154776 A1 6/2010 Czajka
2010/0163013 A1 * 7/2010 Serenellini ..... F23D 14/065 126/39 E
2010/0186730 A1 7/2010 Cadeau et al.
2010/0206293 A1 8/2010 Padgett
2010/0319677 A1 * 12/2010 Lacche ..... F23D 14/065 126/39 E
2011/0048400 A1 * 3/2011 Biagioli ..... F23D 14/06 126/39 E
2011/0120445 A1 * 5/2011 Armanni ..... F23D 14/06 126/39 E
2011/0143295 A1 6/2011 Fowler
2011/0232628 A1 * 9/2011 Bettinzoli ..... F23D 14/06 126/39 E
2013/0199513 A1 * 8/2013 Bettinzoli ..... F23D 14/065 126/39 E
2013/0269676 A1 * 10/2013 Quintaba' ..... F23D 14/065 126/39 E
2014/0116417 A1 * 5/2014 Dora ..... F23D 14/56 126/39 E
2014/0318528 A1 * 10/2014 Quintaba' ..... F23D 14/085 126/39 E
2014/0345598 A1 * 11/2014 Da Silva ..... F23D 14/06 126/39 E

FOREIGN PATENT DOCUMENTS

JP 56030521 A * 3/1981
JP 2006098001 A * 4/2006
WO 20120143319 A1 10/2012

OTHER PUBLICATIONS

European Patent Application No. 14177651.8, filed Jul. 18, 2014, Applicant: Whirlpool Europe, Srl, European Search Report, mail date: Jan. 26, 2015 re: same.

* cited by examiner

INNER SWIRLING FLAME GAS BURNER

BACKGROUND

The present concept relates to a gas burner with an inwardly directed flame.

SUMMARY

A first embodiment of the present concept includes a gas burner including a combustion chamber with a bottom and a circumferential wall. A plurality of fuel exit ports are disposed in the circumferential wall. The ports are directed generally inwardly toward the combustion chamber and upwardly from the bottom of the combustion chamber. A plurality of secondary air inlets extend through the bottom of the combustion chamber.

Another embodiment of the present concept includes a bracket to secure an injector orifice to a cooktop. The bracket includes an orifice securing surface. A first sidewall extends generally orthogonally from a first edge of the orifice-securing surface and terminates in a first fastening flange. A second sidewall extends generally orthogonally from a second edge of the orifice securing surface and terminates in a second fastening flange. A plurality of burner locating slots are formed in the first fastening flange and the second fastening flange. The burner locating slots are asymmetrically distributed.

Yet another embodiment of the present concept includes a gas burner for a cooktop having a plurality of fuel exit ports disposed about a circumference of the burner. The ports are directed generally inwardly and upward from a horizontal plan to generate an inwardly directed flame. An injector orifice is aligned with a central axis of the burner.

The gas burner disclosed herein provides several advantages. For example, cookware placed on the burner is heated effectively and efficiently by the swirling inwardly directed flames, with limited heat loss around the exterior of the cookware. The inwardly directed flames also reduce the risk of a user being burned by the flames, as they are directed to be underneath the cookware. Additionally, the arrangement described herein is resistant to spillage, without openings or holes facing the top of the burner where cookware is placed. The aesthetics of the burner are improved due to the smooth, uninterrupted viewable surface. The burner described herein can also be removed from the cooktop without disconnecting the gas injector, which is secured using the bracket, and replaced in the proper orientation using the asymmetrically arranged tabs and slots described herein.

These and other features, advantages, and objects of the present device will be further understood and appreciated by those skilled in the art upon studying the following specification, claims, and appended drawings.

DETAILED DESCRIPTION OF EMBODIMENTS

Figure 1:
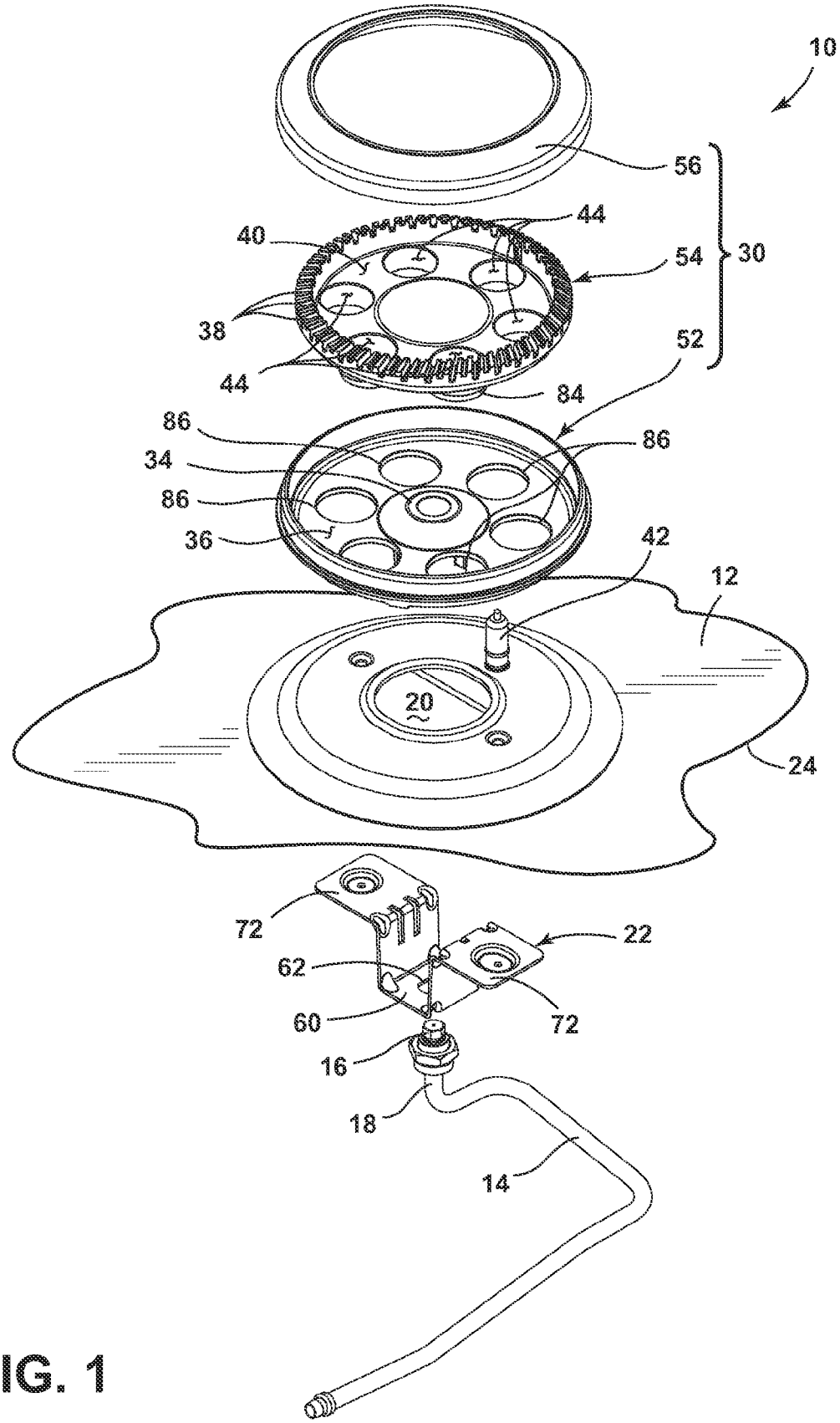
FIG. 1 is an exploded top perspective view of an embodiment of a burner for a cooktop according to the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

In the embodiment of a gas burner 10 for a cooktop 12 depicted in FIG. 1, a gas inlet 14 supplies gas to the burner 10 through an injector orifice 16 at its terminal end 18. The injector orifice 16 is secured in position below an aperture 20 in the cooktop 12 with a bracket 22 that is fastened to an underside 24 of the cooktop 12. A burner assembly 30 includes a gas flow path through a stem 32 (shown in FIG. 2), a venturi tube 34, a mixing chamber 36, fuel exit ports 38, and a combustion chamber 40. Gas is supplied to the burner 10 through the gas inlet 14. Primary air is introduced in the venturi tube 34 to form a combustible gas-primary air mixture in the mixing chamber 36. The gas-primary air mixture is then expelled through the fuel exit ports 38 into the combustion chamber 40, where a spark electrode 42 is disposed to ignite the gas-primary air mixture. Secondary air inlets 44 extend from the combustion chamber 40 to ambient air outside the burner assembly 30, allowing secondary air to be drawn into the combustion chamber 40 by convection to encourage complete combustion. The burner assembly 30 as depicted in the embodiment of FIG. 1 includes a burner base 52, swirl spreader 54, and burner cap 56, which define the functional elements of the stem 32, venturi tube 34, mixing chamber 36, fuel exit ports 38, and combustion chamber 40. Although shown as three parts that are assembled to form the burner assembly 30 in the embodiment depicted in FIG. 1, the functional elements of the burner assembly 30 may be constructed out of more or less assembled parts, and may be integrally formed in a single piece, if desired.

Figure 2:
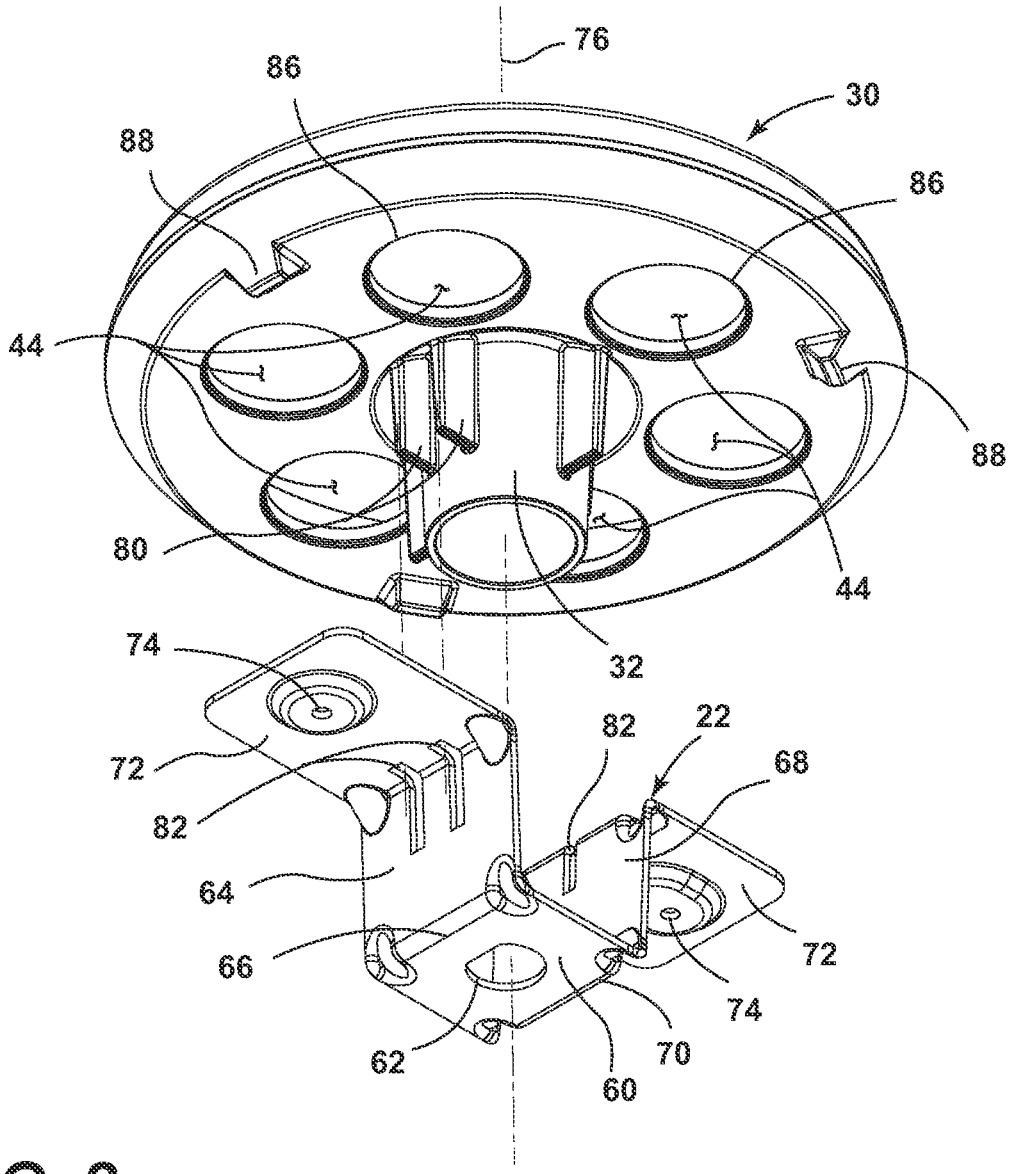
FIG. 2 is a bottom perspective view of the disassembled burner shown in FIG. 1 (with the cooktop and gas inlet omitted for clarity)
Figure 3:
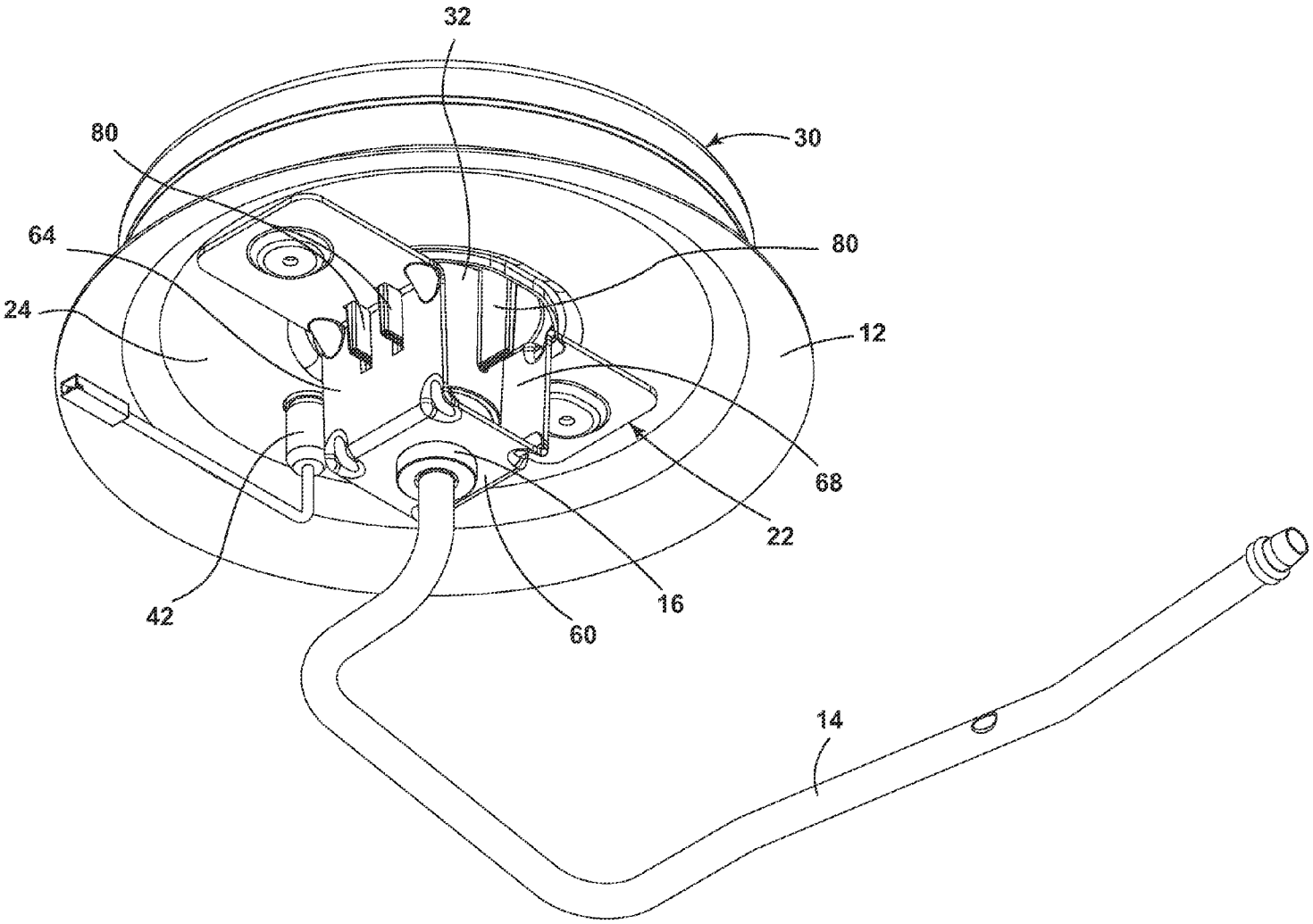
FIG. 3 is a bottom perspective view of the assembled burner shown in FIG. 1.

As shown in FIGS. 2-3, the bracket 22 used to secure the gas inlet 14 includes an orifice-securing surface 60 with a hole 62 therethrough for passage of the gas inlet 14, with the injector orifice 16 held in place above the orifice securing surface 60. The orifice-securing surface 60 shown herein is generally planar and parallel to the underside 24 of the cooktop 12, and is generally square or rectangular shaped. Alternate embodiments may include alternate designs of the orifice-securing surface 60, including without limitation curved edges, a non-planar shape, a slot for passage of the gas inlet 14, etc. A first sidewall 64 extends upwardly from a first edge 66 of the orifice securing surface 60, and a second sidewall 68 extends upwardly from a second edge 70 of the orifice securing surface 60. Each sidewall 64, 68 terminates in an outwardly directed fastening flange 72. The fastening flanges 72 have through holes 74 therethrough, for fastening the bracket 22 to the cooktop 12 with the fastening flanges 72 on opposing sides of the aperture 20. The first sidewall 64 and second sidewall 68 are separated by a distance which is less than the diameter of the cooktop aperture 20, resulting in a portion of each of the fastening flanges 72 being aligned below the cooktop aperture 20. The bracket 22 is secured to the cooktop 12 by positioning it below the cooktop 12 and fastening the bracket 22 to the underside 24 thereof using fasteners (not shown). The bracket 22, when installed, positions the injector orifice 16 generally in the center of the cooktop aperture 20, and, therefore, along a central axis 76 of the gas burner 10.

Also as shown in FIGS. 2-3, the burner assembly 30 is removably secured to the bracket 22 in the desired orientation by aligning a plurality of tabs 80 extending outwardly from the stem 32 with slots 82 that extend through the fastening flanges 72 and sidewalls 64, 68 of the bracket 22, such that the burner assembly 30 is properly aligned with the injector orifice 16. When aligned, the injector orifice 16 directs the flow of gas upward into the stem 32 and venturi tube 34. The slots 82 in the bracket 22 are asymmetrically arranged, with two slots 82 on the first sidewall 64 of the bracket 22 and one slot 82 on the second sidewall 68 of the bracket 22, and a corresponding two tabs 80 on one side of the stem 32 and one tab 80 on an opposing side of the stem 32. The asymmetrical alignment allows the burner assembly 30 to be secured to the bracket 22 in a single orientation, and prevents the use of alternate burner assemblies that are not optimized for use with the particular injector orifice 16 used. As a non-limiting example, when the burner assembly 30, gas inlet 14, and injector orifice 16 are optimized for high efficiency operation, the particular asymmetrical arrangement of slots 82 and tabs 80 can be used to insure that alternate burner assemblies are not installed into the aperture 20 in the cooktop 12.

Also as shown in the embodiment depicted in FIGS. 1-3, the secondary air inlets 44 extend from the combustion chamber 40, through the mixing chamber 36, to ambient air. The secondary air inlets 44 permit the inflow of secondary air to enhance combustion characteristics of the burner 10. As shown in FIGS. 1-3, the secondary air inlets 44 include downwardly depending cylinders 84 which extend from the swirl spreader 54 to apertures 86 in the burner base 52, to create a channel for the flow of secondary air through the mixing chamber 36 (where the secondary air is fluidly separated from the mixing chamber 36). The number of secondary air inlets 44 and their cross sectional area can be varied to provide desired burn characteristics for the burner 10. In the embodiment depicted in FIGS. 1-3, there are six secondary air inlets 44 provided, and they are evenly spaced about the circumference of the burner 10. The burner assembly 30 is raised off of the surface of the cooktop 12 to permit air to enter the secondary air inlets 44 by feet 88 extending downwardly from the burner assembly 30.

Figure 4:
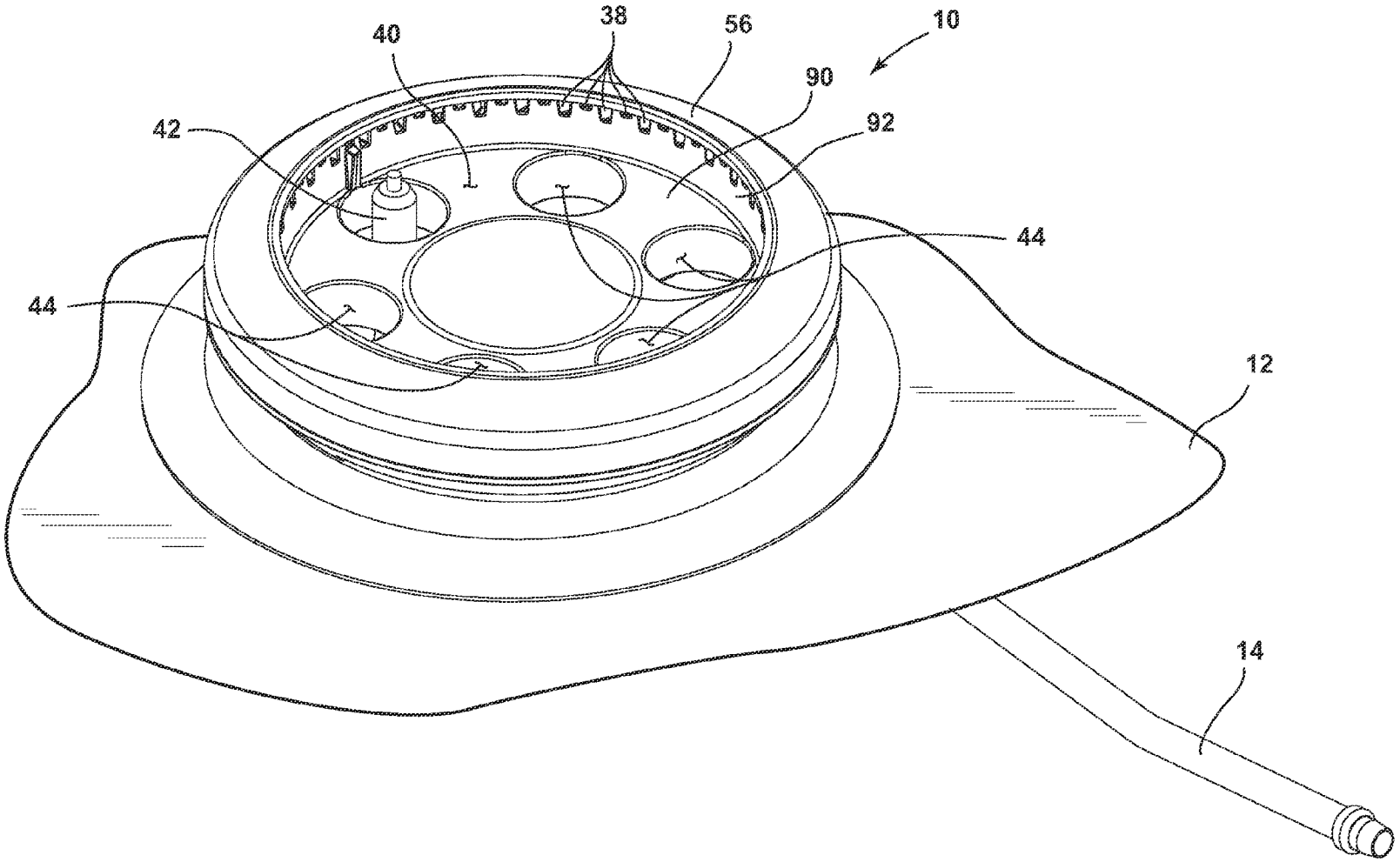
FIG. 4 is a top perspective view of the assembled burner shown in FIG. 1.
Figure 5:
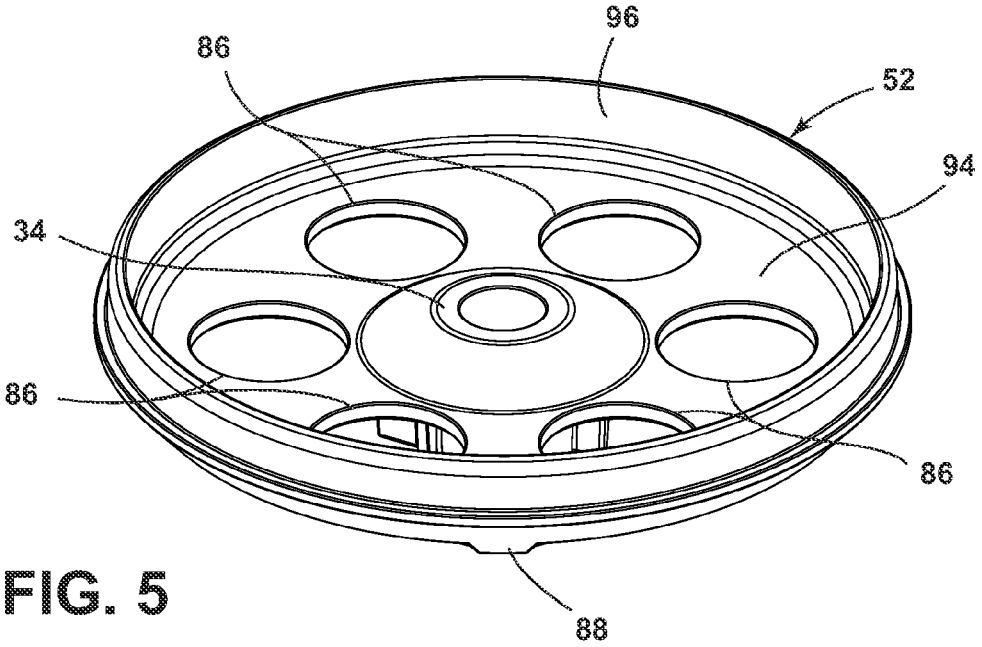
FIG. 5 is a top perspective view of a burner base according to the present disclosure.
Figure 6:
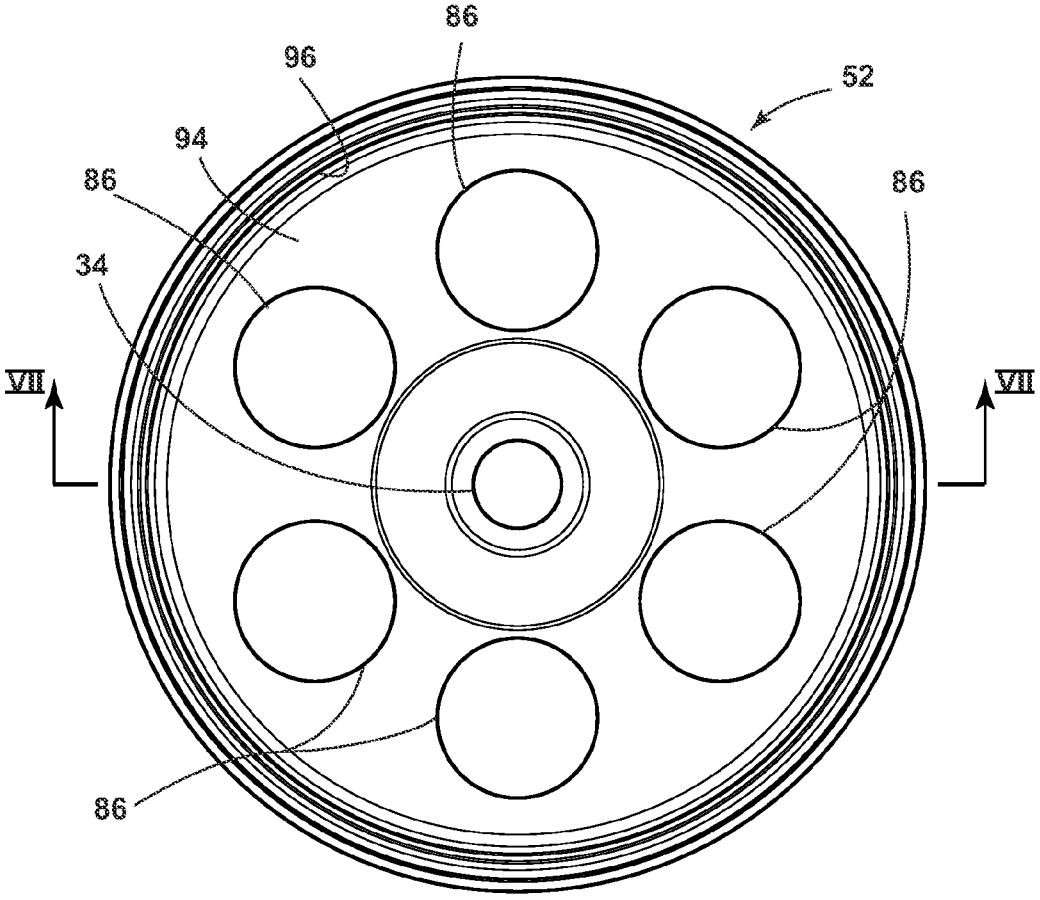
FIG. 6 is a top view of the burner base shown in FIG. 5.
Figure 7:
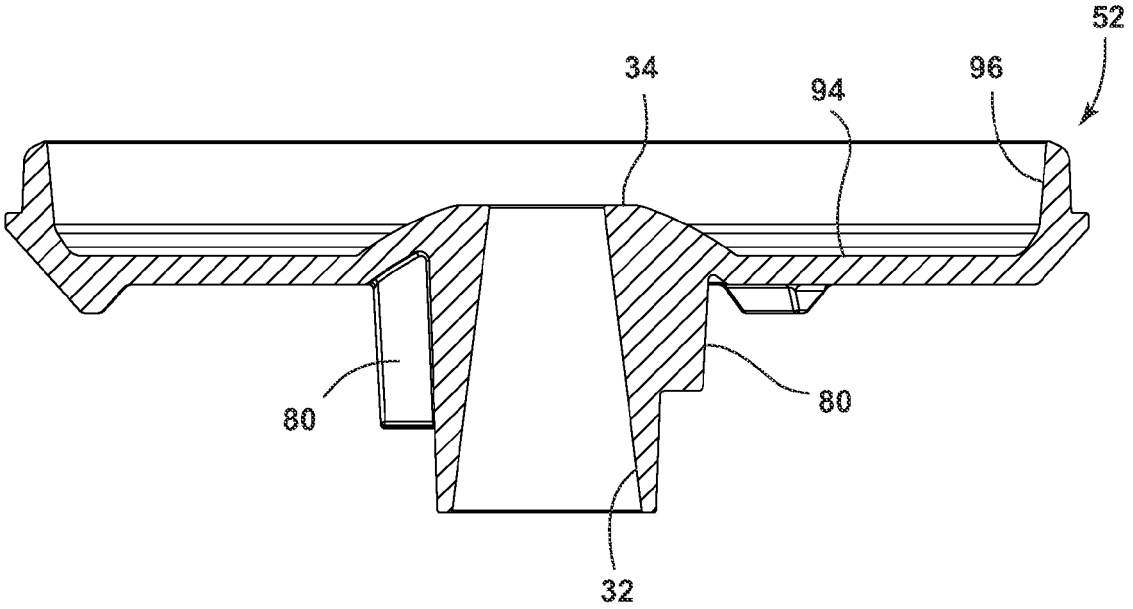
FIG. 7 is a cross sectional view of the burner base taken along line VII-VII shown in FIG. 5.
Figure 8:
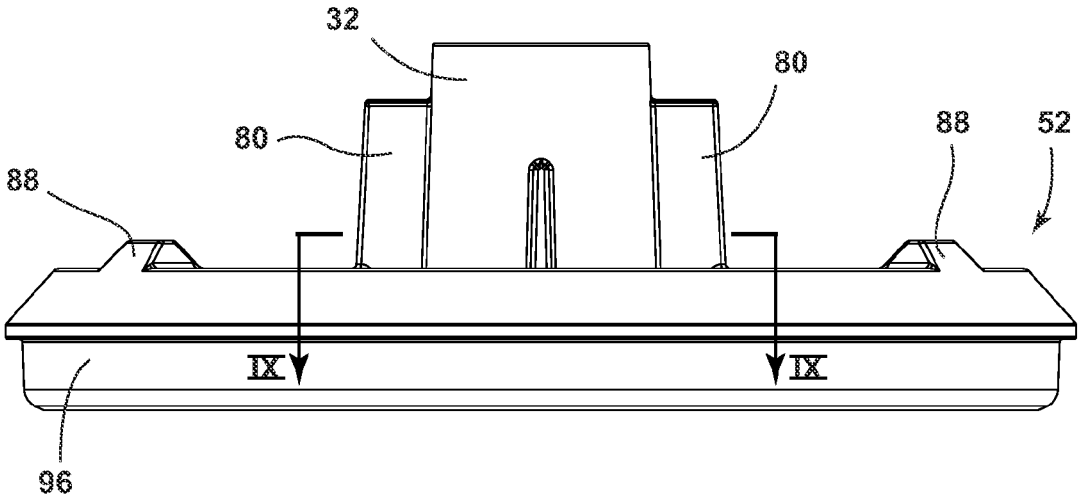
FIG. 8 is a side elevation view of the burner base shown in FIG. 5.

As shown in the embodiment depicted in FIG. 4, the combustion chamber 40 has a bottom 90 and a circumferential wall 92. The plurality of fuel exit ports 38 are disposed in the circumferential wall 92, facing generally inwardly toward the combustion chamber 40, and upwardly from the bottom 90 of the combustion chamber 40. The fuel exit ports 38 direct fuel inwardly and upwardly, where it is ignited by the spark electrode 42, to create an inwardly directed flame within and upwardly from the combustion chamber 40. The fuel exit ports 38 are also optionally directed inwardly at an angle that is slightly rotated from a radial line through the central axis 76 of the burner 10 to create a swirling burner flame. Secondary air inlets 44 supply ambient secondary air to the combustion chamber 40 to aid in combustion of the gas-primary air mixture.

Figure 9:
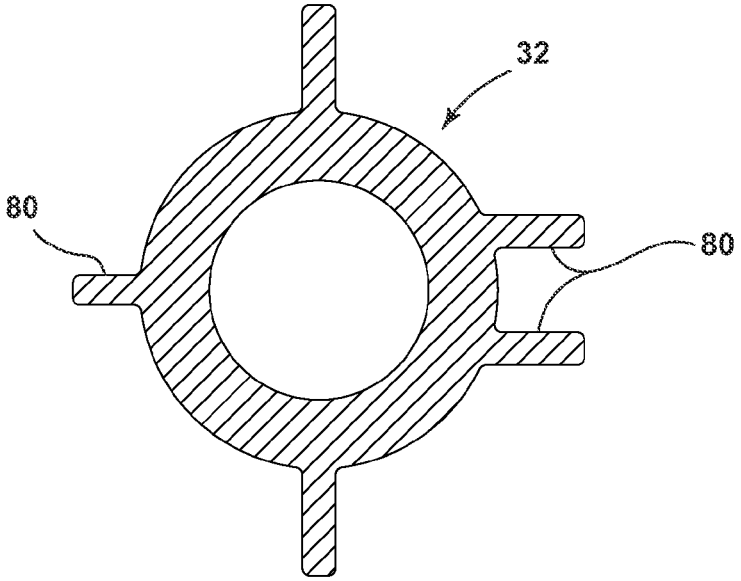
FIG. 9 is a cross section view of the burner base taken along line IX-IX shown in FIG. 8.
Figure 10:
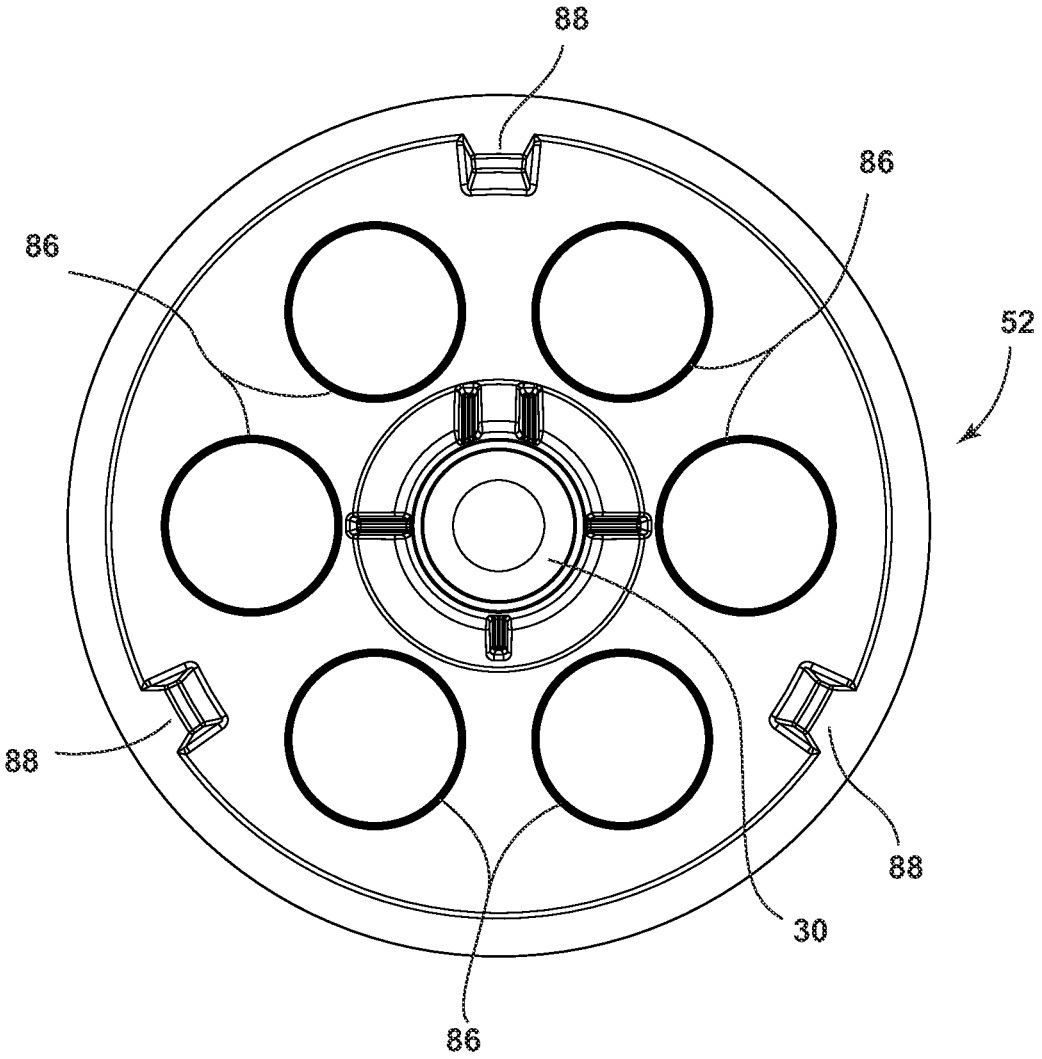
FIG. 10 is a bottom view of the burner base shown in FIG. 5.
Figure 11:
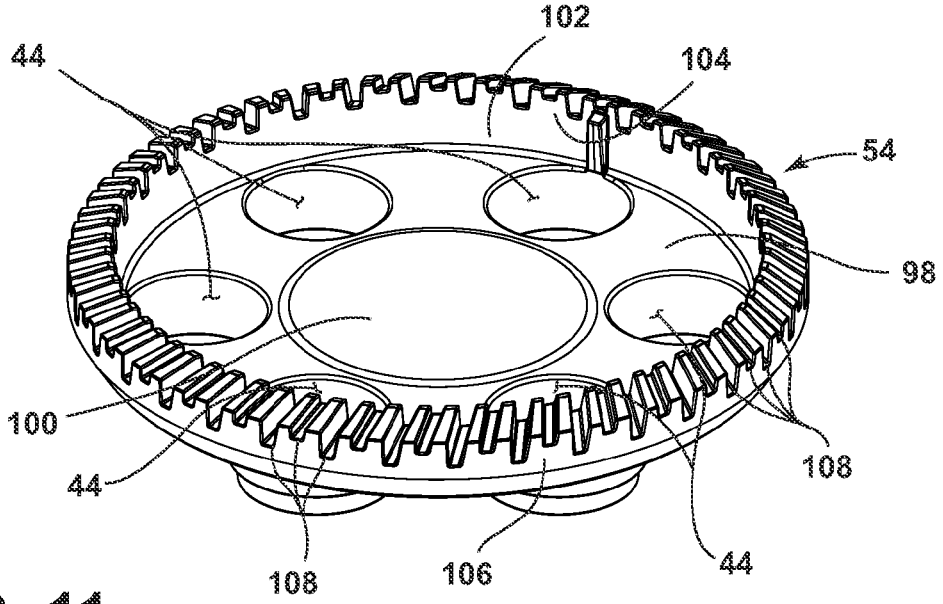
FIG. 11 is a top perspective view of a swirl spreader according to the present disclosure.
Figure 12:
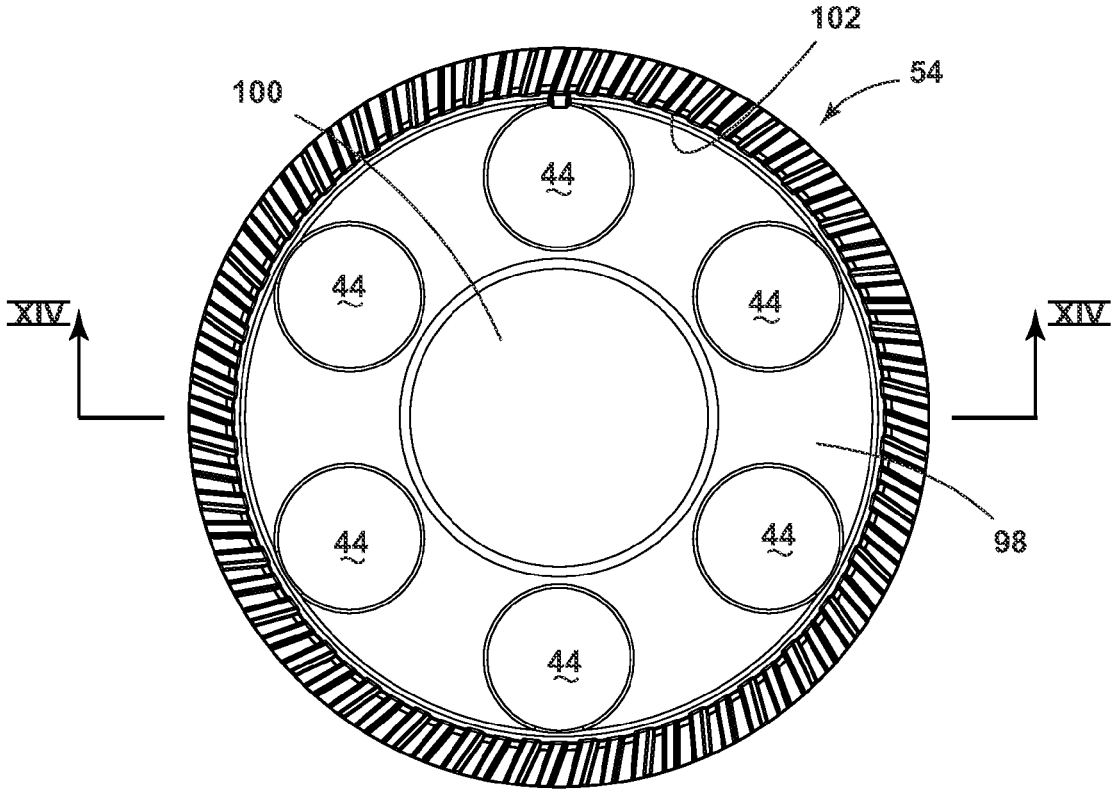
FIG. 12 is a top view of the spreader shown in FIG. 11.
Figure 13:
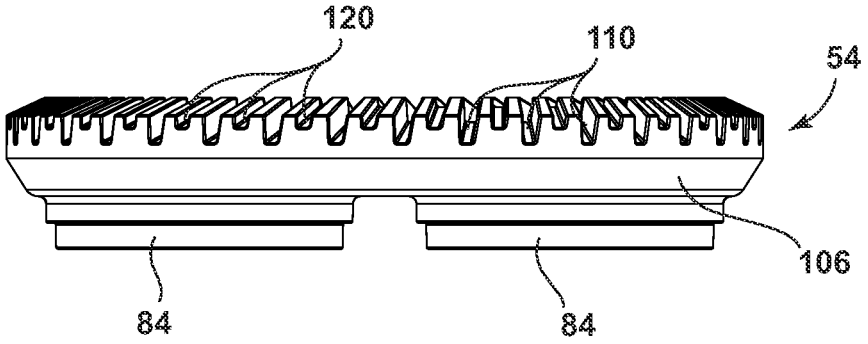
FIG. 13 is a side elevation view of the spreader shown in FIG. 11.
Figure 14:
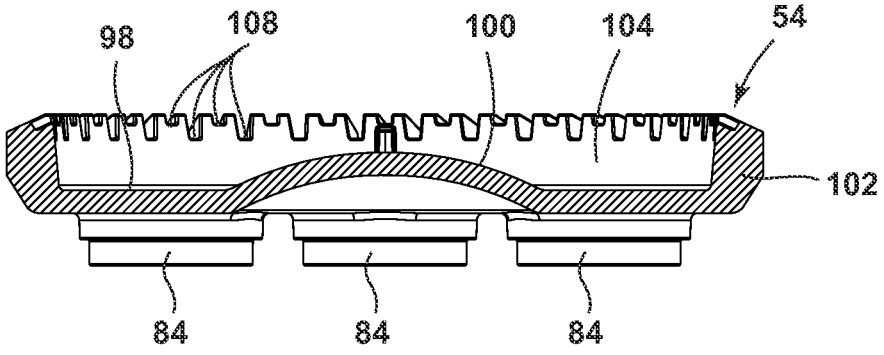
FIG. 14 is a cross sectional view of the spreader taken along line XIV-XIV from FIG. 12.
Figure 15:
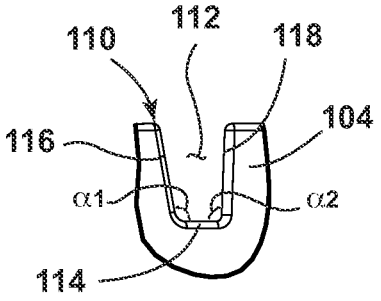
FIG. 15 is a front cutaway view of a first type of fuel exit port in the spreader shown in FIG. 11.
Figure 16:
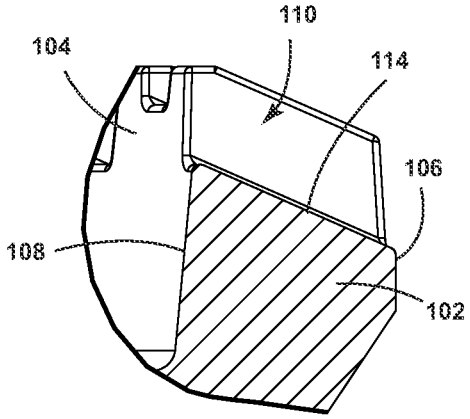
FIG. 16 is a side cross sectional view of the fuel exit port shown in FIG. 15.

FIGS. 5-10 illustrate one embodiment of the burner base 52 for use in a burner 10 according to the present disclosure. The burner base 52 includes a bottom plate 94, with the venturi tube 34 in the center thereof. The stem 32 extends downwardly from the center of the bottom plate 94. The inner diameter of the stem 32 and venturi tube 34 narrows toward the mixing chamber 36. In one embodiment, the inner diameter of the stem 32 and venturi tube 34 narrows from about 20 mm to about 12 mm at the outlet to the mixing chamber 36. The venturi tube 34 opens into the center of the mixing chamber 36, on the central axis 76 of the burner 10. The secondary air apertures 86 are disposed radially outwardly from the venturi tube 34. A peripheral wall 96 extends generally upwardly about the circumference of the bottom plate 94. In the embodiment shown in FIGS. 5-10, the peripheral wall 96 is arranged at an angle from the bottom plate 94 of greater than 90 degrees, such as at an angle of about 95 degrees from the bottom plate 94. The feet 88 extend downwardly from an outer periphery of the bottom plate 94 at even intervals about the circumference to allow air flow to the secondary air inlets 44 through the secondary air apertures 86, so that air can be drawn in through the secondary air inlets 44 by convection when the burner 10 is operated. The feet 88 are preferably tall enough to permit air flow between the burner base 52 and the cooktop 12, such as a height of about 3.0 mm. As best shown in FIG. 9, the plurality of tabs 80 extend outwardly from the stem 32 in an asymmetrical manner, to align with the slots 82 in the bracket 22, as described above. The burner base 52 may be constructed of a material suitable for use in burners 10, including materials that can withstand burner operating temperatures for extended periods of time and over numerous thermal cycles, including without limitation die-cast aluminum, cast iron, ceramics, carbon steel, brass, or heat resistant plastic.

FIGS. 11-19 illustrate one embodiment of the swirl spreader 54 for use in a burner 10 according to the present disclosure. The swirl spreader 54 includes a bottom plate 98, with a raised central portion 100 and the plurality of downwardly depending cylinders 84 disposed radially outwardly therefrom. The downwardly depending cylinders 84 have a sufficient length to reach the burner base 52 when assembled, to create a pathway for secondary air. The downwardly depending cylinders 84 form the secondary air inlets 44, to direct secondary air into the combustion chamber 40 above the bottom plate 98 of the swirl spreader 54. A peripheral wall 102 extends upwardly about the circumference of the bottom plate 98 with an interior side 104 and an exterior side 106. The wall 102 has channels 108 formed along its top edge to form the fuel exit ports 38. Channels 108 (enclosed by the burner cap 56, as further described below) are advantageous fuel exit ports 38 because the channels 108 can easily be cleaned upon removal of the burner cap 56. The number of fuel exit ports 38 can vary among different embodiments, but the fuel exit ports 38 should be sufficient in number and cross sectional area to encourage even mixing of gas and primary air, and to allow sufficient gas to enter the combustion chamber 40 to provide the desired level of heating. The fuel exit ports 38, or channels 108, are aligned with each other, and are arranged at an angle that is slightly rotated from the radial line through the central axis 76 of the burner 10. In the embodiment depicted in FIGS. 11-19, each channel 108 is on an angle of about 20 degrees from the central axis 76. This angle encourages the gas-primary air mixture to swirl upon entering the combustion chamber 40. The fuel exit ports 38 can be arranged at a variety of different angles with respect to the center axis 76 to encourage swirling of the burner flames. The swirl spreader 54 may be constructed of a material suitable for use in burners, including materials that can withstand burner operating temperatures for extended periods of time and over numerous thermal cycles, including without limitation die-cast aluminum, cast iron, ceramics, carbon steel, brass, or heat resistant plastic.

Figure 17:
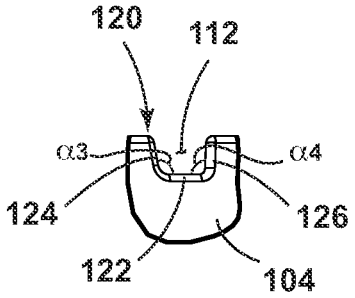
FIG. 17 is a front cutaway view of a second type of fuel exit port in the spreader shown in FIG. 11.
Figure 18:
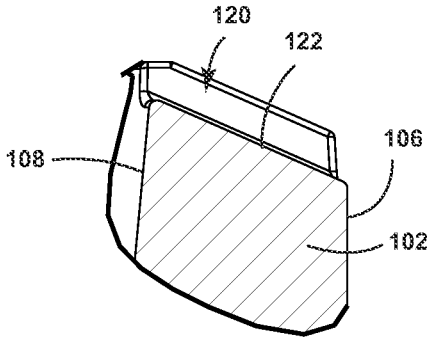
FIG. 18 is a side cross sectional view of the fuel exit port shown in FIG. 16.
Figure 19:
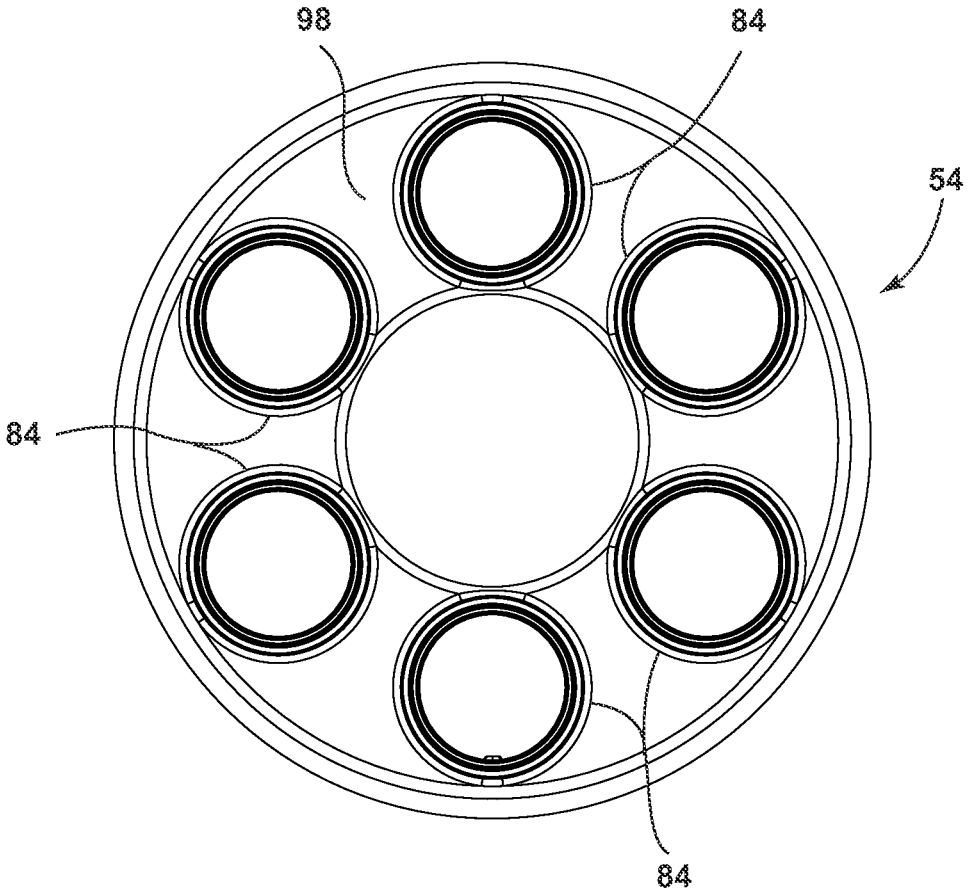
FIG. 19 is a bottom view of the spreader shown in FIG. 11.

The channels 108, as shown in the present embodiment, are of varying depths and cross sectional areas, to optimize the flame characteristics of the burner 10. The channels 108 are shown in detail in FIGS. 15-18, with a first type of channel 110 shown in FIGS. 15-16. The first type of channel 110 has an open top 112 and a first bottom surface 114, which slopes upwardly from the exterior side 106 to the interior side 104 of the peripheral wall 102. The first type of channel 110 also has a first sidewall 116 and a second sidewall 118, with the first sidewall 116 extending upwardly from the first sloping bottom surface 114 at a first angle $\alpha^1$ and the second sidewall 118 extending upwardly from the first sloping bottom surface 114 at a second angle $\alpha^2$. The first angle $\alpha^1$ is greater than the second angle $\alpha^2$. In the embodiment depicted in FIG. 15, both the first angle $\alpha^1$ and the second angle $\alpha^2$ are greater than 90 degrees. The first angle $\alpha^1$ is about 100 degrees from the bottom surface, and the second angle $\alpha^2$ is about 92 degrees from the bottom surface 114. In the embodiment depicted in FIGS. 15-16, the first type of channel 110 has a height of about 3.2 mm and a width of about 1.5 mm. A second type of channel 120 is shown in FIGS. 17-18. The second type of channel 120 has a smaller cross sectional area for the flow of gas than the first type of channel 110, with a height of about 1.3 mm and a width of about 1.5 mm in the embodiment depicted in FIGS. 17-18. The second type of channel 120 also has an open top 112 and a second upwardly sloping bottom surface 122, from the exterior side 106 to the interior side 104 of the peripheral wall 102. The second type of channel 120 also has a third sidewall 124 extending upwardly from the second sloping bottom surface 122 at a third angle $\alpha^3$ and a fourth sidewall 126 extending upward from the second sloping bottom surface 122 at a fourth angle $\alpha^4$. The third angle $\alpha^3$ is greater than the fourth angle $\alpha^4$. Similarly to the first type of channel 110, the third angle $\alpha^3$ is about 100 degrees from the bottom surface 122, and the fourth angle $\alpha^4$ is about 92 degrees from the bottom surface 122.

Figure 20:
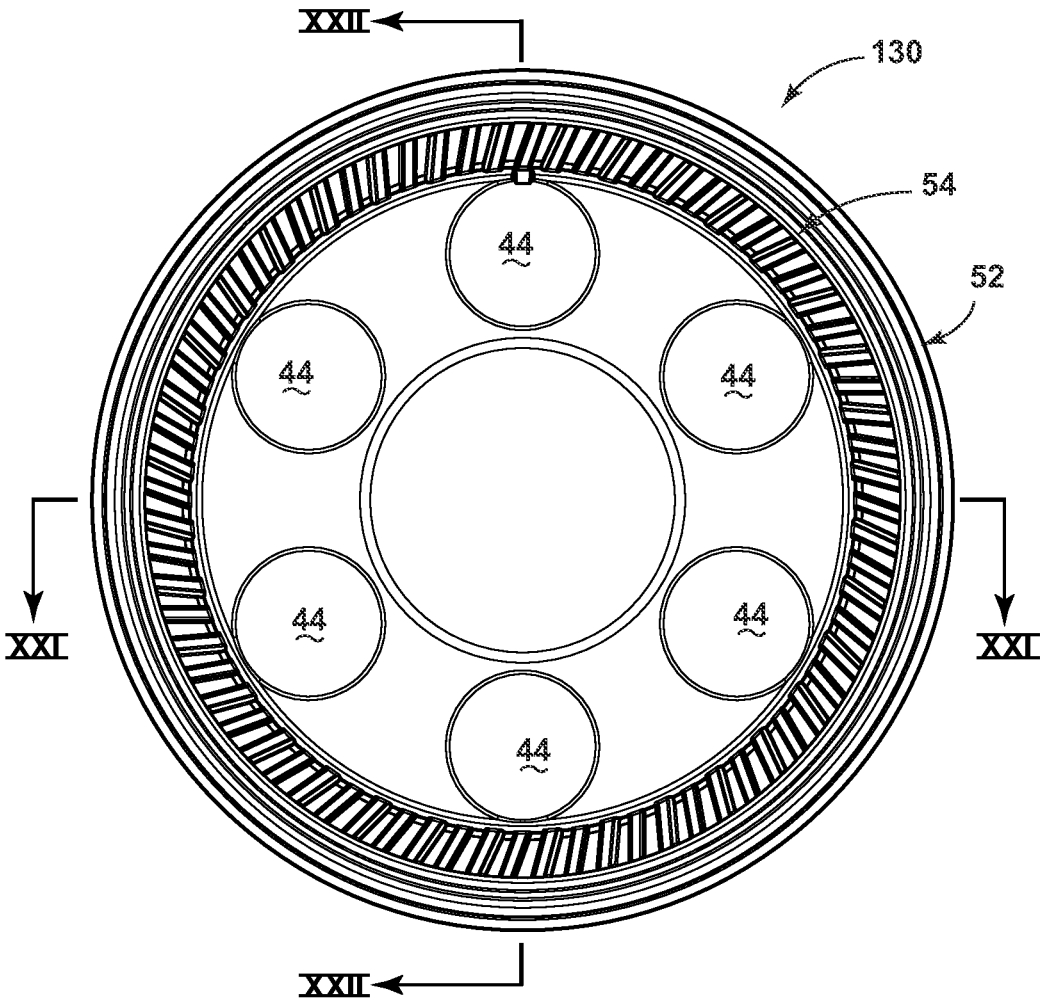
FIG. 20 is a top view of a spreader assembly including the burner base and the spreader according to the present disclosure.
Figure 21:
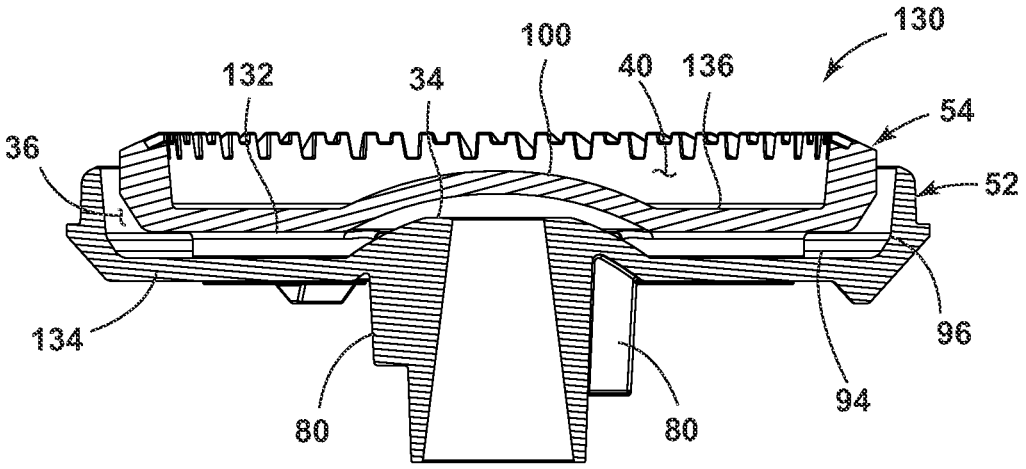
FIG. 21 is a cross sectional view of the spreader assembly taken along line XXI-XXI in FIG. 20.
Figure 22:
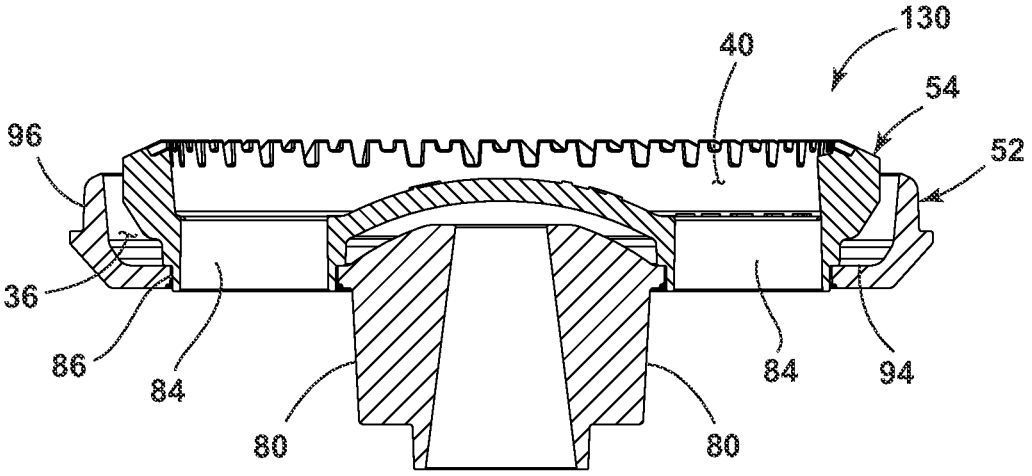
FIG. 22 is a cross sectional view of the spreader assembly taken along line XXII-XXII in FIG. 20.

As illustrated in FIGS. 20-22, the burner base 52 and swirl spreader 54 are assembled to form a spreader assembly 130. The swirl spreader 54 is placed on top of the bottom plate 94 of the burner base 52, radially inwardly from the peripheral wall 96 of the burner base 52. When positioned, one or more downwardly depending cylinders 84 are optionally fitted within the apertures 86 in the burner base 52. The fitting between the downwardly depending cylinder 84 and the aperture 86 in the burner base 52 may also be used to secure the swirl spreader 54 to the burner base 52. The mixing chamber 36 is defined in part by an exterior surface 132 of the swirl spreader 54 and an interior surface 134 of the burner base 52, while the combustion chamber 40 is generally defined by an interior surface 136 of the swirl spreader 52. When positioned, the raised central portion 100 of the swirl spreader 54 accommodates the venturi tube 34 of the burner base 52, and the downwardly depending cylinders 84 of the swirl spreader 54 align with the apertures 86 in the burner base 52.

Figure 23:
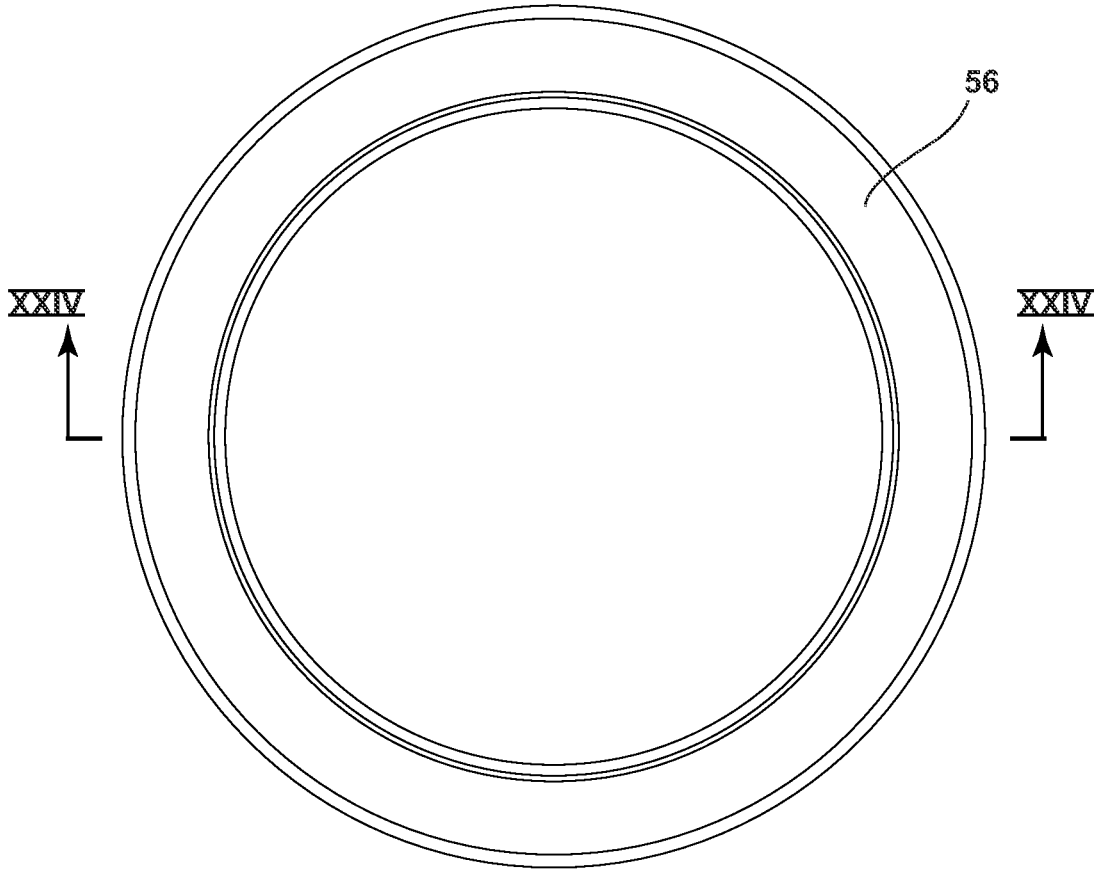
FIG. 23 is a top view of a burner cap according to the present disclosure.
Figure 24:
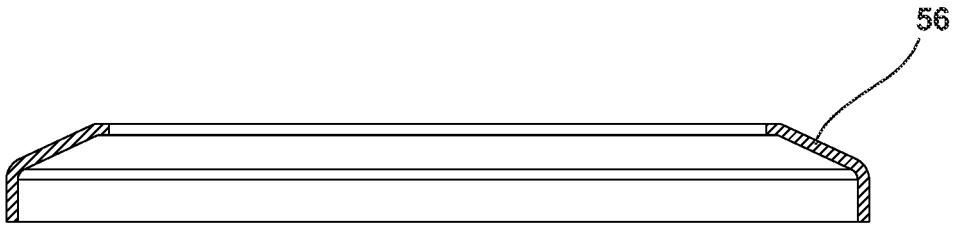
FIG. 24 is a cross sectional view of the burner cap taken along line XXIV-XXIV in FIG. 23.

In one embodiment of the annular burner cap 56, as shown in FIGS. 23-24, the annular burner cap 56 is positioned on top of the spreader assembly 130, where it encloses the top of the mixing chamber 40, between the peripheral wall 96 of the burner base 52 and the peripheral wall 102 of the swirl spreader 54. The burner cap 56 also encloses the top 112 of the channels 108, to direct the flow of gas inwardly toward the combustion chamber 40. The burner cap 56 is optionally shaped to extend over a portion of the peripheral wall 96 of the burner base 52, to retain the burner cap 56 in position. The burner cap 56 may also be constructed of any material suitable for use in burner caps, including without limitation a suitable polished brass alloy or a steel material formed by stamping and sintering metal powder.

In use, gas is supplied to the burner 10 through the gas inlet 14, and is sprayed through the gas injector orifice 16, into the stem 32. The gas then travels through the venturi tube 34, where primary air is introduced. The gas and primary air are expelled into the mixing chamber 36, which is defined by the burner base 52, the swirl spreader 54, and the burner cap 56. The gas and primary air mixture is then forced through the fuel exit ports 38 by pressure in the mixing chamber 36, into the combustion chamber 40. The fuel exit ports 38 direct the gas in an inwardly and upwardly directed swirling configuration. The gas-primary air mixture is ignited in the combustion chamber 40 by the spark electrode 42, and the swirling upwardly directed flame causes secondary air to enter the combustion chamber 40 through the secondary air inlets 44 in the bottom of the combustion chamber 40 by convection to encourage complete combustion.

The gas burner 10 disclosed herein provides several advantages. For example, cookware placed on the burner 10 is heated effectively and efficiently by the swirling inwardly directed flames, with limited heat loss around the exterior of the cookware. Efficiencies of 60% or greater are possible with the swirling inwardly directed flames as described herein. The inwardly directed flames also reduce the risk of a user being burned by the flames, as they are directed to be underneath the cookware. Additionally, the embodiments described herein are resistant to spillage, without openings or holes facing the top of the burner 10 where cookware is placed. The aesthetics of the burner 10 are improved due to the smooth, uninterrupted viewable surface. The burner 10 described herein can also be removed from the cooktop 12 without disconnecting the gas injector 14, which is secured using the bracket 22, and replaced in the proper orientation using the asymmetrically arranged tabs 80 and slots 82 described herein.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A gas burner, comprising:

a combustion chamber having a bottom and a circumferential wall;

a plurality of fuel exit ports disposed in the circumferential wall, the ports adapted to direct fuel generally inwardly toward the combustion chamber and upwardly from the bottom of the combustion chamber, wherein each fuel exit port includes a substantially vertical wall extending upward at a first angle and an opposing angled wall extending upward at a second angle, the second angle being greater than the first angle to form an asymmetrical fuel exit port; and a plurality of secondary air inlets extending through the bottom of the combustion chamber.

2. The gas burner of claim 1, wherein the ports are directed inwardly at an angle that is slightly rotated from a radial line through the center of the burner to create a swirling flame, wherein the opposing angled wall is angled away from the center of the burner to further create the swirling flame.

3. The gas burner of claim 1, wherein the combustion chamber is defined by a burner assembly, and wherein the burner assembly is elevated off of a cooktop to allow air to pass under the burner assembly.

4. The gas burner of claim 3, wherein the burner assembly has a plurality of feet to support the burner assembly above the cooktop.

5. The gas burner of claim 1, further comprising a mixing chamber, wherein the mixing chamber is disposed below the combustion chamber, and wherein the secondary air inlets extend through the mixing chamber.

6. The gas burner of claim 5, further comprising:

a burner base; and a swirl spreader disposed above the burner base, wherein the mixing chamber is disposed between the burner base and swirl spreader, and wherein the swirl spreader includes downwardly depending cylinders which extend through the mixing chamber to apertures in the burner base to define secondary air inlets.

7. The gas burner of claim 1, further comprising:

an injector orifice aligned with a central axis of the burner.

8. The gas burner of claim 1, further comprising:

a burner base;

a swirl spreader which is disposed above the burner base, and which defines the bottom and the circumferential wall of the combustion chamber; and an annular burner cap which is disposed on a top portion of the circumferential wall and which, together with the swirl spreader, defines the fuel exit ports in the circumferential wall.

9. A gas burner for a cooktop, comprising:

a plurality of fuel exit ports disposed about a circumference of the burner, the ports directed generally inwardly and upwardly from a horizontal plane to generate an inwardly directed flame, wherein each fuel exit port includes a substantially vertical wall and an opposing angled wall, wherein each opposing angled wall of the fuel exit ports angles away from a vertical axis of the burner; and an injector orifice aligned with a central axis of the burner.

10. The gas burner of claim 9, wherein the ports are directed inwardly at an angle that is slightly rotated from a radial line through the center of the burner to create a swirling flame, and wherein each fuel exit port includes a flared end positioned at an interior side of the burner that opens into a combustion chamber of the burner.

11. The gas burner of claim 9, wherein the injector orifice is secured by a bracket secured to an underside of the cooktop.

12. The gas burner of claim 9, wherein the injector orifice directs gas into a stem of a spreader assembly, wherein the stem of the spreader assembly is operably coupled to a mixing chamber, and wherein the mixing chamber is operably connected to a combustion chamber by the fuel exit ports.

13. The gas burner of claim 12, wherein the mixing chamber includes a bottom portion which is disposed below the combustion chamber and a peripheral portion which is disposed radially outwardly from the combustion chamber.

14. The gas burner of claim 13, further comprising:

an annular burner cap which seals a top edge of the peripheral portion of the mixing chamber.

15. The gas burner of claim 13, wherein the combustion chamber further includes secondary air inlets, which allow the passage of ambient air into the combustion chamber.

16. The gas burner of claim 15, wherein the secondary air inlets extend through the mixing chamber, and prevent fluid communication between gas in the mixing chamber and air in the secondary air inlets.

* * * * *